US006192652B1

(12) United States Patent
Goer et al.

(10) Patent No.: US 6,192,652 B1
(45) Date of Patent: Feb. 27, 2001

(54) SPACING PROFILE FOR DOUBLE-GLAZING UNIT

(75) Inventors: Bernhard Goer, Recklinghausen; Franz-Josef Rotmann, Essen; Juergen Regelmann, Witten, all of (DE)

(73) Assignee: Flachglas Aktiengesellschaft, Fuerth (DE)

( * ) Notice: Subject to any disclaimer, the term of this patent is extended or adjusted under 35 U.S.C. 154(b) by 0 days.

(21) Appl. No.: 09/300,308

(22) Filed: Apr. 27, 1999

(30) Foreign Application Priority Data

Apr. 27, 1998 (DE) ..... 298 07 413 U
Jan. 29, 1999 (DE) ..... 199 03 661

(51) Int. Cl.[7] ..... E04C 1/42

(52) U.S. Cl. ..... 52/786.13; 52/786.1; 52/788.1; 52/309.14; 52/204.6

(58) Field of Search ..... 52/786.1, 786.13, 52/788.1, 204.6, 309.14

(56) References Cited

U.S. PATENT DOCUMENTS 4,226,910 * 10/1980 Dahlen et al. ..... 52/309.14 X
4,564,540 * 1/1986 Davies et al. ..... 428/34
4,850,175 * 7/1989 Berdan ..... 52/790
5,088,258 * 2/1992 Schield et al. ..... 52/398
5,094,055 * 3/1992 Berdan ..... 52/397
5,209,034 * 5/1993 Box et al. ..... 52/171
5,512,341 * 4/1996 Newby et al. ..... 428/35.8
5,640,815 * 6/1997 Chinzi ..... 52/172
5,962,090 * 10/1999 Trautz ..... 428/34

FOREIGN PATENT DOCUMENTS 33 02 659 8/1984 (DE) .
298 14 768 U 2/1999 (DE) .
441232 * 8/1949 (IT) ..... 52/786.1

* cited by examiner

*Primary Examiner*—Carl D. Friedman
*Assistant Examiner*—Phi Dieu Tran A
(74) *Attorney, Agent, or Firm*—Marshall & Melhorn

(57) ABSTRACT

A spacing profile for a spacing frame, which is to be fitted in the edge area of a double-glazing unit, forming an interspace, with a profile body of a material possessing low thermal conductivity and with a diffusion-impermeable metal foil which is bonded to the profile body so as to establish a material fit, is characterized in that the metal foil is, at least on the surface facing away from the profile body, provided with a corrosion preventing coating which comprises a colored lacquer coating and/or a layer of chromium or of a chromium alloy, wherein the corrosion preventing coating comprises a thickness which is lower by at least a factor of 2.5, preferably by at least a factor of 10 and further preferred by at least a factor of 20, as compared to the thickness of the metal foil.

20 Claims, 2 Drawing Sheets

SPACING PROFILE FOR DOUBLE-GLAZING UNIT

BACKGROUND OF THE INVENTION

1. Field of the Invention

The invention concerns a spacing profile for a spacing frame which is to be fitted in the edge area of a double-glazing unit, forming an interspace, with a profile body of material possessing low thermal conductivity and with a diffusion-impermeable metal foil, which is joined to the profile body to establish a material fit.

2. Description of the Prior Art

Within the scope of the invention, the panes of the double-glazing unit are normally glass panes of inorganic or organic glass, without of course the invention being restricted thereto. The panes can be coated or finished in any other way in order to impart special functions to the double-glazing unit, such as increased thermal insulation or sound insulation.

The profile body of the spacing profile of material possessing low thermal conductivity constitutes, in respect of volume, the main part of the spacing profile and imparts its cross-sectional profile to it.

By "bonded to establish a material fit" is meant that the profile body and the metal layer are durably bonded to one another, for example by coextrusion of the profile body with the metal layer or by laminating the metal layer on separately, if necessary by means of a bonding agent or similar methods.

For some considerable time it has also been the practice to make use of plastic spacing profiles instead of metal spacing profiles for the manufacture of high thermal-insulation double-glazing units in order to take advantage of the low thermal conduction of the former materials.

By materials with low thermal conductivity in the sense of the invention should be understood those which evidence a coefficient of thermal conductivity which is significantly reduced in comparison with metals, that is to say by at least a factor of 10. The coefficients of thermal conductivity $\lambda$, for such materials are typically of the order of 5 W/(m*K) and below; preferably, they are less than 1 W/(m*K) and more preferably less than 0.3 W/(m*K). Plastics generally fall within this definition.

Of course, plastics generally possess low impermeability to diffusion in comparison with metals. In the case of plastic spacing profiles, it is necessary therefore to ensure by special means that atmospheric humidity present in the environment does not penetrate into the interspace to the extent that the absorption capacity of the desiccant generally accommodated in the spacing profiles is not soon exhausted, thus impairing the reliability performance of the double-glazing unit. Furthermore, a spacing profile must also prevent filler gases from the interspace, such as for example argon, krypton, xenon, sulphur hexafluoride, escaping from it. Vice versa, nitrogen, oxygen, etc., contained in the ambient air should not enter the interspace. Where impermeability to diffusion is involved below, this means impermeability to vapor diffusion, as well as impermeability to gas diffusion for the gases stated.

To improve impermeability to vapor diffusion, it is known from DE 33 02 659 A1, which has been employed for formulation of the preamble of claim 1, to provide a plastic spacing profile with a vapor barrier by applying to the plastic profile, on the side facing away from the interspace in installed state, a thin metal foil or a metallized plastic foil.

This metal foil must span the interspace practically fully so that the desired vapor barrier effect will occur. Generally, the metal foil will be extended into the regions of the surfaces of the contact flanges of the spacing profile through which the profile is bound to the pane surfaces with the aid of a layer of sealing material.

EP 0 430 889 A2 suggests in the same context to provide a plastic spacing profile with a vapor diffusion impermeable layer by applying to the plastic profile, on the side facing away from the interspace in installed state, a thin layer, for example of chromium or a chrome-nickel alloy, by means of a physical coating process, for example by sputtering. These manufacturing processes are on the one hand complex and expensive, but on the other hand as well, are the only ones to permit production of extremely thin vapor-diffusion impermeable layers at acceptable cost.

Nowadays, preferably one part spacing frames are made from spacing profiles which are bent at three corners and at which the connection of the end parts is accomplished by corner joints or a straight joint, respectively, inserted into the end parts. One endeavors to accomplish the bending of the corners as simply as possible in terms of production technique, in particular without prior costly heating. The profiles of EP 0 430 889 A2 are not susceptible for spacing frames to be fabricated in this manner. The vapor-diffusion impermeable layers applied therein with thicknesses of 70 to 400 nm do not possess the necessary tearing resistance.

To enable cold bending of spacing profiles made of materials possessing low thermal conductivity, spacing profiles have been developed in which the profile body of material possessing low thermal conductivity is bonded to establish a material fit with a plastically deformable reinforcing layer, preferably a metal foil. This reinforcing layer may also be diffusion impermeable and span the entire width of the interspace, whereby the required diffusion impermeability of the spacing profile is achieved. A spacing profile of this type has been introduced under the name THERMOPLUS® TIS® for example in prospectus "Impulse fur die Zukunft (Impulses for the Future)" of Flachglas AG and is described in DE 298 14 768 U1. The reinforcing layer imparts good cold-bendability to the spacing profile to manufacture the above mentioned one-part spacing frames. It has, however, been found that the tinplate layer used for the reinforcing layer is not sufficiently corrosion resistant. It has been observed that the tinplate layer sometimes is already partly corroded when arriving at the insulating glass manufacturer, if it has been imparted to water or high air humidity before.

SUMMARY OF THE INVENTION

It is the object of the invention to provide for an improved corrosion prevention for a spacing profile of material possessing low thermal conductivity with a diffusion-impermeable metal foil. Thereby, the invention shall enable the provision of aesthetically attractive spacing profiles and, in particular, be usable for cold-bendable spacing profiles, e.g. according to DE 298 14 768 U1.

According to the invention in its first aspect, provision is made that the diffusion-impermeable metal foil, at least on the surface facing away from the profile body, is provided with a layer of chromium or of a chromium alloy, whose thickness in comparison with the thickness of the metal foil is lower by at least a factor of 2.5, preferred at least a factor of 10 and further preferred by at least a factor of 20.

Typically, the thickness of the layer comprised of chromium or of a chromium alloy is less than about one tenth of the thickness of the metal foil. It is preferred that the layer comprises a thickness between 0.01 μm and 5 μm. By this extremely low thickness, compared to the metal foil, it is achieved that the thermal conductivity through the spacing profile is not considerably increased by applying the corrosion preventing coating, the additional costs remain low and the cold-bendability of the spacing profile is not detrimentally affected. Preferably, a pure chromium layer is employed. It lies however within the scope of the invention to use alloying additives, which selectively modify the properties of the chromium-based layer, provided that these additives not exceeding 50 atomic percent do not significantly reduce the desired anti-corrosion action of the coating.

Preferably, the metal foil possesses on both surfaces a layer of chromium or chromium alloy. With the additional coating on the surface facing towards the profile body, the adherence of the foil to the plastic of the profile body can be improved.

Of course, the chromium containing layer is generally oxidized, at least superficially. It is known that chromium is easily oxidizable so that, when a freshly applied chromium surface comes in contact with oxygen, a thin passivating oxide layer quickly forms, which then effectively prevents or significantly retards further progress of oxidation.

Further improvement of the adhesion of the metal foil to the profile body can—as already mentioned—be achieved if the chromium containing layer is provided, on the side facing towards the profile body, with an adhesive coating, in particular with a metal primer. Here in particular, metal primers which are usual for the manufacture of motor vehicle ornamental profiles of metal-plastic laminates and which are typically applied in a thickness of approximately 5 to 10 μm, have proved eminently suitable.

Often, it cannot be avoided that the metal foil in the installed state of the spacing profile can be seen at least partly from outside, and this in particular when the metal foil extends on the contact flanges facing to the inner sides of the panes very far in direction to the interspace. The metal-shining surface of the metal foil is different from the dull surface of the mostly dark-tinted plastic profile body conspicuously, so that variations due to tolerances of the position of the lateral ends of the metal foil become particularly well visible. This is aesthetically unsatisfactory. Furthermore, it can be disadvantageous and lead to enhanced corrosion sensitivity if the metal foil—with chromium containing layer or without—is exposed to solar radiation or other light sources.

Therefore, it is further provided according to the invention in a second aspect that the metal foil, at least on the surface facing away from the profile body, is provided with a corrosion preventing coating which comprises a colored lacquer coating, wherein its thickness in comparison to the thickness of the metal foil is lower by at least a factor of 2.5, preferably by at least a factor of 10. The lacquer coating is preferably applied in a thickness of 1 to 30 μm, generally in thicknesses of 3 to 10 μm. It has proved that with lacquer coatings applied in such thicknesses onto the metal foil even under extreme conditions a high corrosion resistancy of the metal foil can be achieved. With the small thickness in comparison to the metal foil, it is achieved that the additional costs remain low and the (cold) bendability of the spacing profile is not detrimentally affected.

In connection with the invention, lacquer coating means a thin coating, applied by spraying, dipping or the like lacquer applying method, from a liquid and/or powderized solid substance, which, by chemical reaction and/or physical alteration, forms a wear resistant continuous film on the metal foil which remains adhered even during bending and which has simultaneously a decorative and corrosion preventing function. The lacquer coating covers preferably the respective surface substantially over the entire area. It has been found that by such thin lacquer coatings, a good and durable corrosion protection can be achieved since they do not tend to form cracks even during cold bending.

The lacquer coating according to the invention is colored, resulting in that it will absorb luminous and UV radiation to a large extent and thereby protects the metal foil against harmful luminous radiation. Colored means the sensory impressions normally mediated through the human eye, such as red, blue, green, white, black or mixtures, also of different brightness gradation and tone. The color of the lacquer coating is generally produced by the addition of absorbent pigments or other coloring agents. If the profile body consists of a timed plastic material, the color of the lacquer coating is preferably adapted to the color of the plastic material of the profile body. It is in particular preferred, under aesthetical and technical aspects, to have the profile body as well as the lacquer coating colored in black.

It is preferred that the lacquer coating is also applied to the surface of the metal foil facing the profile body. In this case, the lacquer coating can optionally take on the task of a metal primer between metal foil and profile body.

It is preferred that the lacquer coating according to the invention is applied onto the metal foil through a metal primer layer. Metal primers on basis of silane have proven to be in particular suitable.

Due to manufacturing technique, it may be that the metal foil, in the installed state of the spacing profile, extends to the interspace. Therefore, it is within the scope of the invention, to additionally provide exposed edges of the metal foil with a lacquer coating.

Plastic materials have turned out to be in particular suitable for fabrication of the profile body, as they are subject matter of the still unpublished DE 198 59 866. These materials contain for example 1 wt. % of a color batch selected following the color RAL 9004 (black pigment).

Surprisingly, preferred lacquers for the lacquer coating according to the invention have proved those lacquers which have been produced with binding agents on basis of polyurethane, epoxide or caoutchouc. Particularly suitable lacquer coating materials have proven such with a binding agent on basis of caoutchouc, in particular partly polymerized caoutchouc, which are suitable to join caoutchouc containing plastic material with metals. The lacquer coatings according to the invention show a good bending behavior, so that they are suitable for cold bendable profiles, in particular according to DE 298 14 768 U1.

It is important for the lacquer coatings according to the invention that they exhibit a good adhesion to the sealing adhesives which are applied to insulating glass panes for outside bonding, preferably to such of polysulfide, silicone or polyurethane. This is the case for the before mentioned lacquers.

It is preferred to use lacquers with black pigments following the color RAL 9004.

Generally, the proportion of binding agents and pigments is 30 to 50 wt. % for the used lacquers. Beside a respective proportion of common solvents, the lacquers can optionally comprise fillers and/or additives.

It is also within the scope of the invention to combine the corrosion preventing measures according to the first aspect and according to the second aspect and, for example, to provide a metal foil firstly with a layer of chromium or of a chromium alloy and then with a colored lacquer coating having the indicated specifications. The metal foil can also be provided on one of its surfaces with a corrosion preventing coating made of a layer of chromium or of a chromium alloy and on the other surface with a corrosion preventing coating made of a colored lacquer coating.

Unfinished sheet iron is primarily suitable as a cost-effective and readily deformable material for the metal foil. The sheet iron can optionally be tin-plated or electrolytically galvanized (zinc-coated).

The metal foil should possess a thickness of at most than 0.2 mm, preferably 0.8 to 0.13 mm. The minimum layer thickness should be chosen such that the necessary impermeability to diffusion combined with any mechanical characteristic striven for (for example cold-bendability) can be achieved. Experience shows that for sheet iron, a minimum thickness of 0.02 mm is necessary.

Preferably, the profile body is configurated with hollow section with the formation of a desiccant cavity. The invention is especially suitable for use with spacing profiles of material with low thermal conductivity, which incorporate contact flanges for contact with the inside of a pane, which are joined by means of bridge sections to a desiccant cavity, where the diffusion-impermeable layer is bonded to establish a material fit to the contact surface of the contact flanges, to the surface of the bridge sections facing away from the interspace and to the outer surfaces of the walls of the cavity facing away from the interspace (DE 298 14 768 U1).

As suitable materials with low thermal conductivity for the profile body, thermoplastics with a coefficient of thermal conductivity $\lambda<0.3$ W/(m*K), for example polypropylene, polyethylene terephthalate, polyamide or polycarbonate, have proved suitable. The plastic can contain usual timers, additives, pigments, materials for UV protection, etc.

It is preferred to use the following plastic materials for fabricating the profile body:

Material 1:

| Material component | Trade name | Proportion in wt. % |
|---|---|---|
| Polypropylene block copolymer with proportion of grafted polyethylene | Borealis BA 101 E antur of company Borealis A/S, Lyngby, Denmark | 73% |
| Polypropylene with 20 wt. % proportion of French chalk | Borealis MB 200 U natur of company Borealis A/S., Lyngby, Denmark | 24% |

Material 2:

| Material component | Trade name | Proportion in wt. % |
|---|---|---|
| Polypropylene homopolymer | Adstif 680 ADXP natur of company Montell, Wesseling, Germany | 5% |
| Polypropylene block copolymer having proportion of grafted polyethylene | Borealis BA 101 E natur of company Borealis A/S, Lyngby, Denmark | 68% |
| Polypropylene with 20 wt. % proportion of French chalk | Borealis MB 200 U natur of company Borealis A/S, Lyngby, Denmark | 24% |

The plastic materials contain optionally further 1 wt. % of a color/batch suitable for implementing the color RAL 9004 and 2 wt. % of a UV stabilizer.

BRIEF DESCRIPTION OF THE DRAWINGS

The invention will be explained below with the aid of the following drawings.

DESCRIPTION OF THE PREFERRED EMBODIMENT

Figure 1:
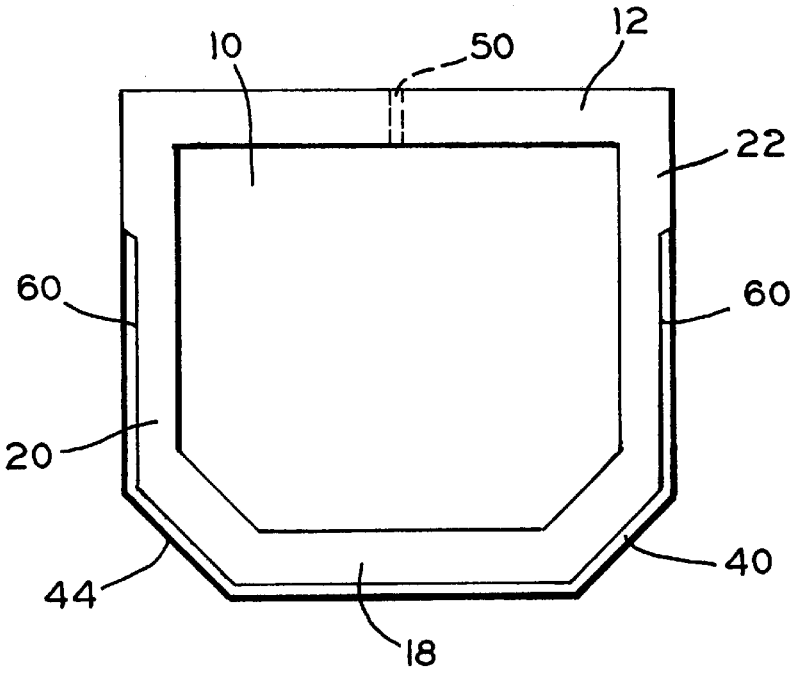
FIG. 1 shows a first embodiment of a spacing profile in cross-section.
Figure 2:
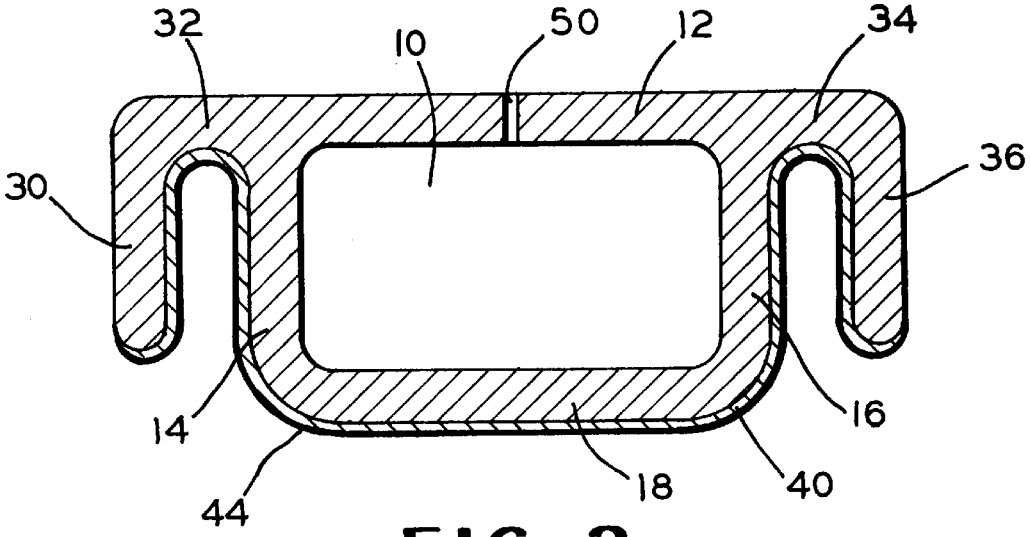
FIG. 2 shows a second embodiment of the spacing profile in cross-section.
Figure 4:
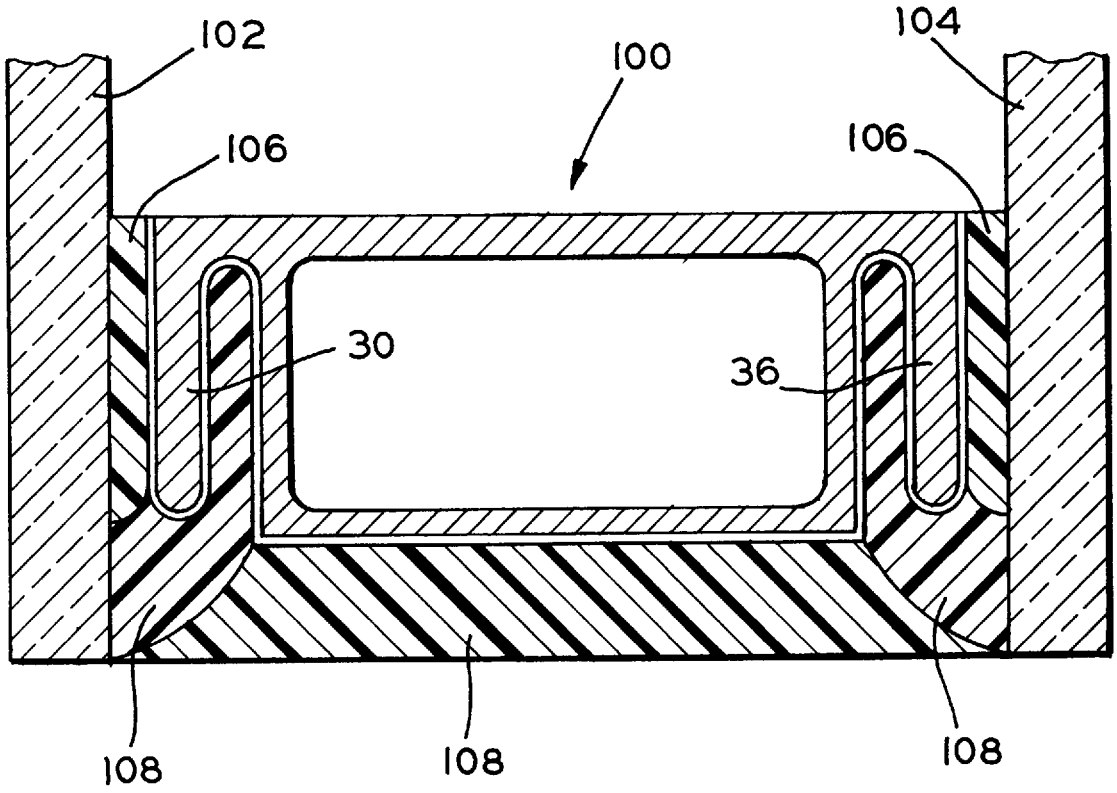
FIG. 4 shows a cross-sectional view of a spacing profile in installed state in a double-glazing unit.

The cross-section shown in FIGS. 1, 2 and 4 does not normally vary over the entire length of a spacing profile, apart from manufacturing tolerances.

FIG. 1 illustrates a first embodiment of a spacing profile according to the present invention. The profile body of black-tinted (color RAL 9004) plastic material (e.g. Material 1 or Material 2) consists of an inner wall 12 which faces towards the interspace in installed state, two side walls 20 and 22 intended for contact with the insides of the panes and thus forming contact flanges, as well as a rear wall 18 adjacent thereto. By means of the walls 12, 20, 22, 18 is defined a desiccant cavity 10 which will subsequently be filled with hygroscopic materials. To enable moisture to enter the desiccant cavity 10 from the interspace, perforations 50 are provided in the inner wall 12. The side walls 20, 22 arc each provided with a recess 60 in their surfaces intended for contact with the insides of the panes, which commence at a certain distance from the ends of the side walls 20, 22 facing towards the interspace and extend along its entire remaining surface. In the recesses 60, on the outer surface of the rear wall 18 and of the transition areas between the side walls 20, 22 and the rear wall 18, is arranged a diffusion-impermeable metal foil 40 of 0.12 mm thick sheet iron being on one side, namely on the surface facing outwardly with a corrosion preventing coating 44, which metal foil is bonded to establish a material fit to the profile body. The depth of the recess 60 corresponds exactly to the thickness of the metal foil 40, so that the contact surface formed by the profile body and the contact surface formed by the metal foil onto which, during manufacture of the double-glazing unit, a thin layer of sealing material (not shown) is applied, lie in one plane. The chemical composition of the used sheet iron is (in wt. %): Carbon 0.070%, manganese 0.400%, silicon 0.018%. aluminium 0,045%, phosphorus 0.02%, nitrogen 0,007%, remainder iron.

The corrosion preventing coating 44 comprises either a colored lacquer coating or a layer of chrome or of a chromium alloy. It can, however, also comprise a layer of chromium or of a chromium alloy, on which additionally a colored lacquer coating has been applied.

The chromium containing layer, for example of chrome 99.9 or of a chromium alloy dominantly containing chromium, can be applied for example by electroplating or another suitable coating method. It is, as mentioned already above, normally superficially oxidized. The chromium containing layer is preferably applied with a basis weight or mass per unit area of about 60 to 120 mg/m$^2$ per surface, corresponding to a layer thickness of about 0.01 $\mu$m.

If a lacquer coating is used as the corrosion preventing coating 44, one can work for example with a black lacquer with a binding agent on basis of a partly polymerized caoutchouc with the designation PC 265 of the German company HÜHOCO, Wuppertal, which presents basically the same optical appearance as the black tinted plastic material of the profile body. Between the lacquer coating of about 5 μm thickness and the metal foil, for example a metal primer of the type PM02 of the company HÜHOCO can be arranged.

The embodiment illustrated in FIG. 2 is based on a profile shape, as is to be taken for example from DE 298 14 768 U1. By means of walls 12, 14, 16, 18 is defined a desiccant cavity 10 for subsequent filling with hygroscopic materials, the connection between this cavity 10 and the interspace being established by means of perforations 50. Contact flanges 30 and 36 intended in installed state for contact with the insides of the panes are connected to the cavity 10 by means of bridge sections 32 and 34, where a diffusion-impermeable metal foil 40 is arranged spanning the interspace and following the outer contour of the profile body. The metal foil 40 additionally acts in the area of the contact bridges 30, 36 as reinforcing layer guaranteeing the cold-bendability of the profile.

Figure 3:
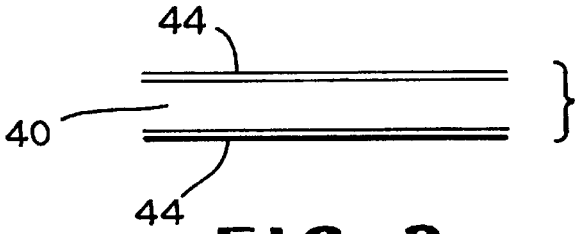
FIG. 3 shows a diagrammatical cross-section view of the diffusion-impermeable layer.

A diagrammatic sectional view through the diffusion-impermeable layer according to the present invention is shown in FIG. 3. The diffusion-impermeable metal foil 40 consists, as an example, of sheet iron. On both surfaces of the metal foil 40, the corrosion preventing coating 44 according to the invention consisting of a colored lacquer coating and/or a layer of chromium or of a chromium alloy has been applied by a suitable coating process.

Example 1

A 0.12 mm thick sheet iron with the technical designation "T 57 specially chromium-plated extra-light gauge sheet ECCS/TFS" from Messrs. Rasselstein Hoesch, GmbH, Andernach, Germany, was used for tests with the invention, onto both sides of which had been applied a chromium layer which in final state contains, the chromium layer having a mass per unit area of 80–90 mg/m$^2$ per surface, which corresponds to a layer thickness of approximately 0.01 μm. Onto the surface of the chromium-plated sheet iron intended for bonding with the profile body was applied for improved adhesion a metal primer Type 4629 of Messrs. HÜMOCO, Wuppertal, Germany, with a thickness of approximately 8 μm. The sheet iron pretreated in this way was shaped mechanically to the desired shape and bonded to the profile body to establish a material fit by extrusion-coating with plasticized polypropylene with a material thickness of approximately 1 mm.

For corrosion tests, a diffusion-impermeable metal foil according to the invention was applied to a 10 cm long by 1.6 cm wide spacing profile with a profile body of polypropylene according to FIG. 2. In addition, for the purpose of comparison, an unprotected tinplate layer was applied to a corresponding profile. The two profiles were subjected to the corrosion tests described below:

A: Water storage for 168 hours at ambient temperature in de-ionized water.

B: Storage in humid atmosphere for 72 hours at 50° C., 100% relative air humidity, vapor from de-ionized water.

After completion of the tests, it was found that the surfaces of the metal foils configured according to the invention either evidenced no visible corrosion or at all events evidenced localized traces of corrosion (rust), which could be removed completely by single brushing or wiping off. In contrast, the surfaces of the unprotected tinplate evidenced widespread symptoms of corrosion, which could no longer be removed by brushing off. Example 2

A 0.12 mm thick sheet iron with a technical designation TFS of Messrs. Rasselstein, Neuwied, was used, on which on one side a 5 μm thick lacquer coating of a lacquer with a binding agent on basis of a partly polymerized caoutchouc was applied. The metal foil thus prepared, after roll shaping during an extrusion process, was bonded to establish a material fit through the above mentioned metal primer with one of the plastic materials specified above as "Material 1" or "Material 2" to form spacing profile according to FIG. 2 so that the lacquer coating was located on the surface of the metal foil facing the outside in installed state.

For corrosion tests, a 10 cm long by 1.6 cm wide portion has been taken from the spacing profile. For the purpose of comparison, additionally corresponding spacing profiles without lacquer coating, but with metal foils of tin-plated sheet foil, have been tested. The profiles were subjected to the tests described below:

1) Salt spraying test 48 h according to DIN 50018.
2) Condensation water storage in humid atmosphere for 168 h at 50° C., 100% relative air humidity, vapor from de-ionized water.
3) Water storage for 672 h at ambient temperature.

After completion of the test, it was found that the surfaces of the metal foils configured according to the invention with a black lacquer coating evidenced no visible corrosion. The surfaces of the metal foils of tin-plated sheet iron, in contrast, showed large area corrosion phenomena in particular after tests 1) and 3), partly with considerable damages at the metal foils.

The results illustrate the high corrosion resistance of the metal foils configured according to the invention with a corrosion coating of a chromium containing layer or with a colored lacquer coating as compared with metal foils of the prior art. The corrosion resistivity can still further be enhanced when a layer of chromium or of a chromium alloy is combined with a colored lacquer coating. Surprisingly, this comparatively high corrosion resistance, even when bending the metal foils during the course of manufacture of the spacing profiles, as well as during subsequent handling spacing profiles, is essentially retained.

FIG. 4 shows the spacing profile 100 in installed state between two panes 102, 104 of a double-glazing unit. The spacing profile 100 corresponds essentially to that of the embodiment of FIG. 2. The contact flanges 30, 36 are connected to the insides of the panes 102, 104 through a layer of sealing material 106. The remaining space between the spacing profile 100 and the outer edges of the panes 102, 104 is filled with mechanically stabilizing sealing adhesive log. It has been found that the corrosion preventing coating according to the invention (not illustrated here) adheres very well at this sealing adhesive 108.

For bonding tests, according to prEN 1279, section 6, so called barbonding samples of a length of 20 mm have been fabricated from the spacing profiles manufactured for the above corrosion tests and were tested with the following sealing adhesives:

1. Polysulfide Terostat 998 R of company Teroson, Heidelberg, Germany
2. Silicone Y3-3362 of company Dow Corning, Unterensingen, Germany
3. Polyurethane PRC 4429 of company Courtaulds Aerospace, Glendale, USA Under a load of 0.3 N/mm$^2$, no peeling of these three tested sealing adhesives from the corrosion preventing coating of the metal foils has been determined over 10 minutes. The adhesion fulfilled the required demands in full.

The features disclosed in the foregoing description, in the claims and/or in the accompanying drawing may, both separately and in any combination thereof, be material for a realizing the invention in diverse forms thereof.

What is claimed is:

1. A spacing profile for a spacing frame, which is to be fitted in the edge area of a double-glazing unit, forming an interspace, with a profile body of a material possessing low thermal conductivity and with a diffusion-impermeable metal foil which is bonded to the profile body so as to establish a material fit, characterized in that the metal foil is, at least on the surface facing away from the profile body, provided with a corrosion preventing coating which comprises a layer of chromium, a layer of chromium alloy or a layer of colored lacquer coating, or a combination of a colored lacquer coating with either a layer of chromium or a layer of chromium alloy, wherein the corrosion preventing coating comprises a thickness which is lower by at least a factor of 2.5, as compared to the thickness of the metal foil.

2. The spacing profile of claim 1, wherein the metal foil comprises a corrosion preventing coating on both surfaces.

3. The spacing profile of claim 2, wherein the corrosion preventing coating is provided, at least on the surface facing the profile body, with an adhesive coating.

4. The spacing profile of claim 1, wherein the metal foil consists of tin-plated or zinc coated sheet foil.

5. The spacing profile of claim 1, wherein the metal foil comprises a thickness of at least 0.02 mm and at most 0.2 mm.

6. The spacing profile of claim 1, wherein the profile body is configured with hollow section with formation of a desiccant cavity.

7. The spacing profile of claim 6, including contact flanges for contact with the inside of a pane, which are connected by means of bridge sections to the desiccant cavity, where the metal foil is bonded to establish a material fit to the contact surface of the contact flanges, the surfaces of the bridge sections facing away from the interspace, and the outside surfaces of the walls of the desiccant cavity.

8. The spacing profile of claim 1, wherein the layer of the corrosion preventing coating alloy comprise consists of a layer of chromium or a layer of chromium alloy and has comprises a thickness of at least 0.01 $\mu$m and at most 5 $\mu$m.

9. The spacing profile of claim 1, wherein the profile body consists of a tinted platic material.

10. The spacing profile of claim 9, wherein the color of the lacquer coating of the corrosion preventing coating is adapted to the color of the plastic material of the profile body.

11. The spacing profile of claim 10, wherein the lacquer coating of the corrosion preventing coating and the plastic material of the profile body are tinted in black.

12. The spacing profile of claim 1, wherein a metal primer layer is arranged between the lacquer coating of the corrosion preventing coating and the metal foil.

13. The spacing profile of claim 1, wherein the lacquer coating of the corrosion preventing coating has a thickness of 1 to 30 $\mu$m.

14. The spacing profile of claim 1, wherein the lacquer coating of the corrosion preventing coating is fabricated from a lacquer with a binding agent of basis of polyurethane, epoxide or caoutchouc.

15. The spacing profile of claim 1, wherein the lacquer coating of the corrosion preventing coating is fabricated of a lacquer with a binding agent of basis of a partly polymerized caoutchouc.

16. The spacing profile of claim 1, wherein the corrosion protective coating comprises a thickness which is lower by at least a factor of 10 as compared to the thickness of the metal foil.

17. The spacing profile of claim 1, wherein the corrosion protective coating comprises a thickness which is lower by at least a factor of 20 as compared to the thickness of the metal foil.

18. The spacing profile of claim 2, wherein said adhesive coating is a metal primer.

19. The spacing profile of claim 5, wherein the metal foil comprises a thickness in the range of from 0.08 to 0.13 mm.

20. The spacing profile of claim 13, wherein the lacquer coating of the corrosion preventing coating has a thickness in the range of from 3 to 10 $\mu$m.

* * * * *